US011415923B2

(12) United States Patent
Hasegawa et al.

(10) Patent No.: US 11,415,923 B2
(45) Date of Patent: Aug. 16, 2022

(54) TRANSPORT DEVICE AND IMAGE FORMING APPARATUS

(71) Applicant: FUJIFILM Business Innovation Corp., Tokyo (JP)

(72) Inventors: Shinya Hasegawa, Kanagawa (JP); Toyohide Sakamoto, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 89 days.

(21) Appl. No.: 16/773,005

(22) Filed: Jan. 27, 2020

(65) Prior Publication Data

US 2021/0080892 A1 Mar. 18, 2021

(30) Foreign Application Priority Data

Sep. 13, 2019 (JP) ..... JP2019-167686

(51) Int. Cl.
*G03G 15/00* (2006.01)
*B65H 3/52* (2006.01)
*G03G 21/16* (2006.01)

(52) U.S. Cl.
CPC ..... *G03G 15/6511* (2013.01); *B65H 3/5261* (2013.01); *G03G 15/6517* (2013.01); *G03G 21/1695* (2013.01)

(58) Field of Classification Search
CPC ..... G03G 15/6511; G03G 15/6517; G03G 21/1695; B65H 3/5261
See application file for complete search history.

(56) References Cited

U.S. PATENT DOCUMENTS 8,348,268 B2 * 1/2013 Urban ..... B65H 5/38 271/264
2004/0146323 A1 * 7/2004 Fujisawa ..... G03G 15/2028 399/323
2010/0207323 A1 * 8/2010 Kumeta ..... B65H 5/38 271/264
2010/0301550 A1 * 12/2010 Muratani ..... B65H 7/06 271/264
2014/0063162 A1 * 3/2014 Iijima ..... B41J 3/60 347/104
2020/0033765 A1 * 1/2020 Shimodaira ..... G03G 15/2064
2020/0180897 A1 * 6/2020 Shimizu ..... B65H 45/20

FOREIGN PATENT DOCUMENTS

JP 2008-094523 A 4/2008
JP 2015-171938 A 10/2015

* cited by examiner

*Primary Examiner* — David H Banh
(74) *Attorney, Agent, or Firm* — Sughrue Mion, PLLC

(57) ABSTRACT

A transport device includes a transport roller, a nip section, and first and second transport path surfaces. The transport roller transports a transport target material sent from an accommodating unit. The nip section nips the transport target material with the transport roller, and prevents multi-feed of the transport target material. The first transport path surface is disposed upstream of the nip section in a transport direction to face a transport roller side of the nip section. The first transport path surface includes a top portion protruding toward the transport roller side beyond a nip line between the transport roller and the nip section. The second transport path surface is disposed downstream of the nip section in the transport direction to face the transport roller side of the nip section. The second transport path surface includes a top portion protruding toward the transport roller side beyond the nip line.

19 Claims, 12 Drawing Sheets

TRANSPORT DEVICE AND IMAGE FORMING APPARATUS

CROSS-REFERENCE TO RELATED APPLICATION(S)

This application is based on and claims priority under 35 USC 119 from Japanese Patent Application No. 2019-167686 filed on Sep. 13, 2019.

BACKGROUND

(i) Technical Field

The present invention relates to a transport device and an image forming apparatus.

(ii) Related Art

JP-A-2015-171938 discloses a sheet feeding apparatus including a feeding member that comes into contact with an upper surface of a sheet material and feeds the sheet material to the downstream along a predetermined transport path, a friction separation member disposed at a position facing the feeding member and nipping the transport path to come into contact with a lower surface of the sheet material, and a guide plate having a guide surface that guides a front end portion of the sheet material toward a separation nip portion formed between the feeding member and the friction separation member, upstream of the separation nip portion. A notch portion located upstream of the separation nip portion and opened to the transport path side is formed on a central portion of the guide plate in a width direction perpendicular to the transport direction of the transport path.

JP-A-2008-94523 discloses a separation sheet feeding apparatus including a sheet feeding tray, a sheet feeding roller provided on the sheet feeding direction side of the sheet feeding tray, and a separation pad that elastically contacts the sheet feeding roller. A film having a small slip resistance of a sheet is adhered on a surface of a portion upstream in the sheet feeding direction of a nip portion of the separation pad with the sheet feeding roller. A portion downstream of the nip portion of the separation pad is curved with a radius of curvature smaller than a radius of curvature of the sheet feeding roller, and elastically contacts the sheet feeding roller in a compressive deformed state.

SUMMARY

However, as a transport device, a transport device is considered including a transport roller (for example, feed roller) that transports a transport target material sent from an accommodating unit and a nip section (for example, retard roller) that sandwiches the transport target material with the transport roller and prevents multi-feed of the transport target material. In the transport device, when an entire first transport path surface that is disposed upstream of the nip section in a transport direction, and faces the transport roller side of the nip section, and an entire second transport path surface that is disposed downstream of the nip section in the transport direction, and faces the transport roller side of the nip section are disposed on a nip section side of a nip line between the transport roller and the nip section, the transport target material may not be pressed against the transport roller, and the transport capability of the transport roller may be insufficient.

The term "nip line" refers to a perpendicular line to a line that connects a contact point between the transport roller and the nip section and the center of the transport roller, the perpendicular line that passes through the contact point. When the transport roller and the nip section contact with each other with a width in the transport direction, the center point in the transport direction in the contact area is the contact point.

Aspects of non-limiting embodiments of the present disclosure relate to improving the transport capability of the transport roller compared with the configuration in which the entire first transport path surface and the entire second transport path surface are disposed on the nip section side of the nip line.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a transport device includes a transport roller, a nip section, a first transport path surface, and a second transport path surface. The transport roller is configured to transport a transport target material sent from an accommodating unit. The nip section is configured to nip the transport target material with the transport roller, and prevent multi-feed of the transport target material. The first transport path surface is disposed upstream of the nip section in a transport direction to face a transport roller side of the nip section. The first transport path surface includes a top portion protruding toward the transport roller side beyond a nip line between the transport roller and the nip section. The second transport path surface is disposed downstream of the nip section in the transport direction to face the transport roller side of the nip section. The second transport path surface includes a top portion protruding toward the transport roller side beyond the nip line.

BRIEF DESCRIPTION OF THE DRAWINGS

Exemplary embodiment(s) of the present disclosure will be described in detail based on the following figures, wherein.

DETAILED DESCRIPTION

Hereinafter, an exemplary embodiment of the present invention will be described with reference to the accompanying drawings.

(Image Forming Apparatus 10)

Figure 1:
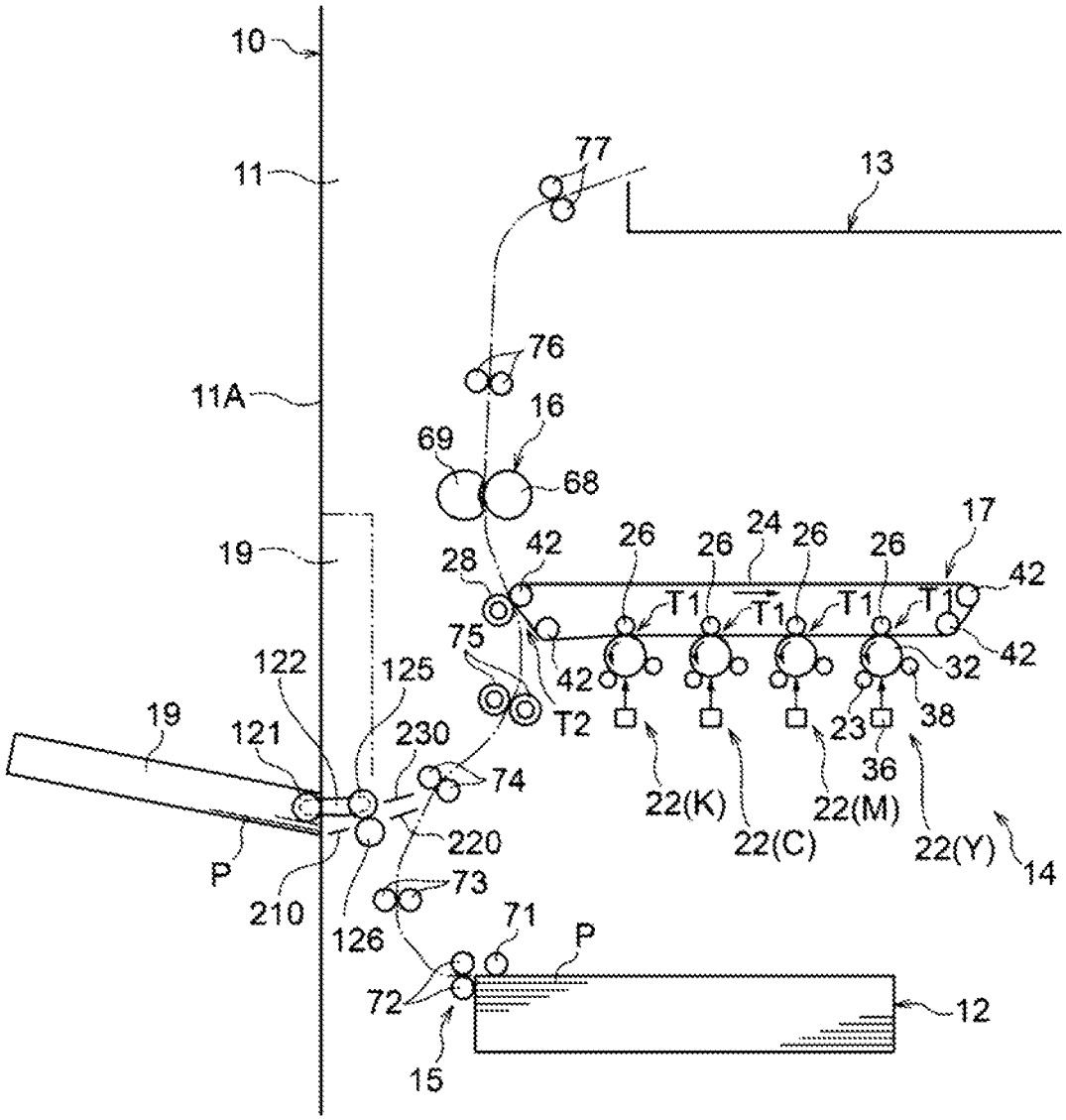
FIG. 1 is a schematic view illustrating a configuration of an image forming apparatus according to an exemplary embodiment.

A configuration of an image forming apparatus 10 according to an exemplary embodiment will be described. FIG. 1 is a schematic view illustrating a configuration of the image forming apparatus 10 according to the exemplary embodiment.

The image forming apparatus 10 illustrated in FIG. 1 is an example of an image forming apparatus that forms an image on a recording medium as an example of a transport target material. Specifically, the image forming apparatus 10 is an electrophotographic image forming apparatus that forms a toner image (an example of an image) on a recording medium P. More specifically, the image forming apparatus 10 includes a first accommodating unit 12, a second accommodating unit 19, a discharge unit 13, a transport device 15, an image forming unit 14, and a fixing device 16. In the following, each of the parts (the first accommodating unit 12, the second accommodating unit 19, the discharge unit 13, the transport device 15, the image forming unit 14, and the fixing device 16) of the image forming apparatus 10 will be described.

(First Accommodating Unit 12, Second Accommodating Unit 19, Discharge Unit 13, and Transport Device 15)

The first accommodating unit 12 and the second accommodating unit 19 have a function of accommodating the recording media P such as paper. The first accommodating unit 12 is formed in a box shape. The first accommodating unit 12 accommodates the recording media P in a stacked state.

The second accommodating unit 19 is a so-called manual feed tray. The second accommodating unit 19 is supported by an apparatus body 11 to be movable between a position (position illustrated by a two-dot chain line in FIG. 1) in a posture along a side surface 11A of the apparatus body 11 of the image forming apparatus 10 and a position (position illustrated by a solid line in FIG. 1) in a posture protruding from the side surface 11A. The second accommodating unit 19 accommodates the recording media P in a stacked state. The second accommodating unit 19 is an example of an accommodating unit.

The discharge unit 13 is a portion to which the recording medium P is discharged. The transport device 15 has a function of transporting the recording medium P. Specifically, the transport device 15 has a function of selectively transporting the recording medium P from the first accommodating unit 12 and the second accommodating unit 19 to the image forming unit 14 (specifically, a secondary transfer position T2 to be described later), the fixing device 16, and the discharge unit 13. A direction in which the transport device 15 transports the recording medium P is hereinafter referred to as a "transport direction". Further, a specific configuration of the transport device 15 will be described later.

(Image Forming Unit 14)

The image forming unit 14 has a function of forming a toner image (an example of an image) on the recording medium P. The image forming unit 14 is disposed downstream of a second transport path surface 222 (to be described later) of the transport device 15 in the transport direction. Specifically, the image forming unit 14 includes a toner image forming unit 22 and a transfer device 17.

(Toner Image Forming Unit 22)

As illustrated in FIG. 1, plural toner image forming units 22 are provided to form toner images for respective colors. In the exemplary embodiment, the toner image forming units 22 are provided for a total of four colors of yellow (Y), magenta (M), cyan (C), and black (K). (Y), (M), (C), and (K) illustrated in FIG. 1 represent components corresponding to the above-mentioned colors, respectively.

Since the toner image forming units 22 for respective colors are configured in the same manner except for the toner to be used, reference numerals are assigned only to the respective parts of the toner image forming unit 22(Y) in FIG. 1 as a representative of the toner image forming units 22 for respective colors.

Each of the toner image forming unit 22 for respective colors includes, specifically, a photoconductor drum 32 (photoconductor) that rotates in one direction (for example, counterclockwise rotation direction in FIG. 1). Further, each of the toner image forming units 22 for respective colors includes a charger 23, an exposure device 36, and a developing device 38.

The charger 23 charges the photoconductor drum 32 in the toner image forming unit 22 for each color. Further, the exposure device 36 exposes the photoconductor drum 32 charged by the charger 23 to form an electrostatic latent image on the photoconductor drum 32. Further, the developing device 38 develops the electrostatic latent image formed on the photoconductor drum 32 by the exposure device 36 to form a toner image.

(Transfer Device 17)

The transfer device 17 illustrated in FIG. 1 is a device that transfers the toner image formed by the toner image forming units 22 to the recording medium P. Specifically, as illustrated in FIG. 1, the transfer device 17 includes a transfer belt 24 as an intermediate transfer member, a primary transfer roller 26, and a secondary transfer roller 28.

The transfer belt 24 includes an annular belt wound around plural rollers 42. The transfer belt 24 circulates in one direction (for example, clockwise rotation direction in FIG. 1) by rotationally driving any of the plural rollers 42.

In the transfer device 17, the primary transfer roller 26 primarily transfers the toner image of the photoconductor drum 32 for each color to be superimposed on the transfer belt 24 at a primary transfer position T1 between the photoconductor drum 32 and the primary transfer roller 26.

The toner image primarily transferred on the transfer belt 24 is transported to a secondary transfer position T2 between the secondary transfer roller 28 and the transfer belt 24 by circulating the transfer belt 24. Then, the secondary transfer roller 28 secondarily transfers the toner image transported to the secondary transfer position T2 to the recording medium P.

The configuration of the image forming unit 14 is not limited to the above configuration. For example, as a configuration of the image forming unit 14, a configuration may be used which transfers directly from the photoconductor drum 32 to the recording medium P without using the transfer belt 24. In this case, for example, a monochrome toner image is transferred to the recording medium P.

(Fixing Device 16)

The fixing device 16 illustrated in FIG. 1 is a device that fixes the toner image transferred to the recording medium P by the secondary transfer roller 28 to the recording medium P. More specifically, as illustrated in FIG. 1, the fixing device 16 includes a heating roller 68 as a heating member, and a pressure roller 69 as a pressure member. In the fixing device 16, the toner image formed on the recording medium P is fixed to the recording medium P by heating and pressurizing the recording medium P by the heating roller 68 and the pressure roller 69.

(Specific Configuration of Transport Device 15)

Specifically, as illustrated in FIG. 1, the transport device 15 includes a sending roller 71, pairs of transport rollers 72, 73, and 74, a pair of registration rollers 75, a pair of transport rollers 76, and a pair of discharge rollers 77.

The sending roller 71 is a roller that sends the recording medium P accommodated in the first accommodating unit 12. The transport rollers 72, 73, and 74 are rollers that transport the recording medium P sent from the first accommodating unit 12 toward the pair of registration rollers 75. The transport rollers 72, 73, and 74 are disposed in this order toward the downstream in the transport direction. A specific configuration of the transport rollers 74 will be described later.

The registration rollers 75 are rollers that transport the recording medium P to the secondary transfer position T2. Specifically, the registration rollers 75 transport the recording medium P to the secondary transfer position T2 in accordance with the transport timing of the toner image transported by the transfer belt 24 to the secondary transfer position T2.

The transport rollers 76 illustrated in FIG. 1 are rollers that transport the recording medium P transported from the fixing device 16 to the discharge rollers 77. The recording medium P transported to the secondary transfer position T2 by the registration rollers 75 is transported to the fixing device 16 by the secondary transfer roller 28 and the transfer belt 24. Further, the recording medium P transported to the fixing device 16 is transported to the transport rollers 76 by the heating roller 68 and the pressure roller 69 of the fixing device 16. Therefore, it may be said that the secondary transfer roller 28 and the transfer belt 24, and the heating roller 68 and the pressure roller 69 constitute a portion of the transport device 15 that transports the recording medium P. The discharge rollers 77 discharge the recording medium P transported from the transport rollers 76, to the discharge unit 13.

In the transport device 15, the recording medium P accommodated in the first accommodating unit 12 is transported to the discharge unit 13 passing through the image forming unit 14 (specifically, the secondary transfer position T2) and the fixing device 16, by the sending roller 71, the pairs of transport rollers 72, 73, and 74, the pair of registration rollers 75, the pair of transport rollers 76, and the pair of discharge rollers 77.

In the exemplary embodiment, the transport device 15 includes guides (not illustrated) such as transport guides disposed between each of the pairs of transport rollers 72, 73, and 74, the pair of registration rollers 75, the pair of transport rollers 76, and the pair of discharge rollers 77. Therefore, the recording medium P is transported in a predetermined transport path. Further, each of the pairs of transport rollers 72, 73, and 74, the pair of registration rollers 75, the pair of transport rollers 76, and the pair of discharge rollers 77 includes a pair of rollers and is configured such that one of the rollers of each pair is driven.

Further, as illustrated in FIG. 1, the transport device 15 includes a sending roller 121, a support 122, a drive roller 125, a separation roller 126, a first guide 210, a second guide 220, and a third guide 230. Hereinafter, each component of the sending roller 121, the support 122, the drive roller 125, the separation roller 126, the pair of transport rollers 74, the first guide 210, the second guide 220, and the third guide 230 will be described.

(Sending Roller 121 and Support 122)

Figure 2:
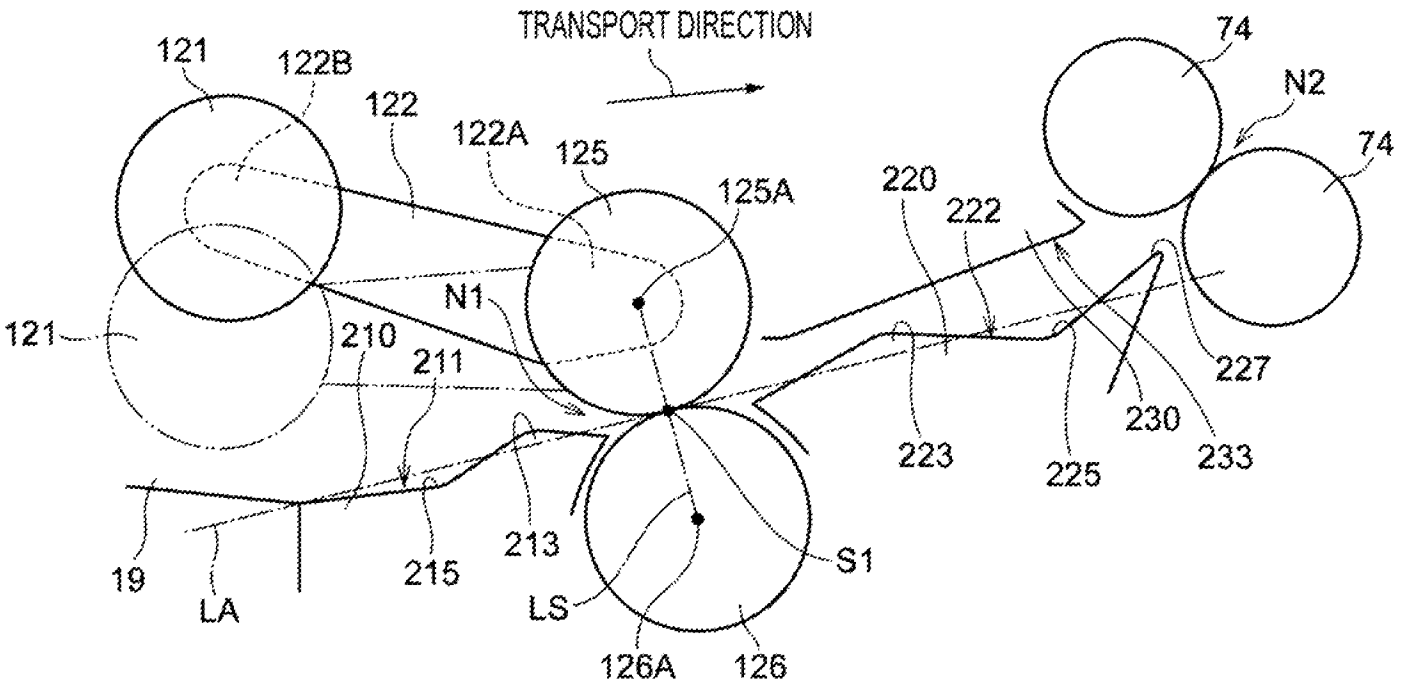
FIG. 2 is a schematic view illustrating a configuration of a portion of a transport device according to the exemplary embodiment.

The sending roller 121 is a roller that sends the recording medium P accommodated in the second accommodating unit 19. As illustrated in FIG. 2, the support 122 is supported at one end portion 122A (specifically, downstream end portion in the transport direction, and right end portion in FIG. 2) to be swingable on the shaft portion of the drive roller 125. The sending roller 121 is attached to the other end portion 122B (specifically, upstream end portion in the transport direction, and left end portion in FIG. 2) of the support 122.

Then, the support 122 is driven by a drive unit (not illustrated), so that the other end portion 122B swings around the axis of the drive roller 125 with the one end portion 122A as a swing center. Therefore, the sending roller 121 moves between a contact position (position illustrated by a two-dot chain line in FIG. 2 and illustrated in FIG. 3) that contacts the recording medium P accommodated in the second accommodating unit 19, and a separation position (position illustrated by a solid line in FIG. 2) that is separated from the recording medium P.

Figure 3:
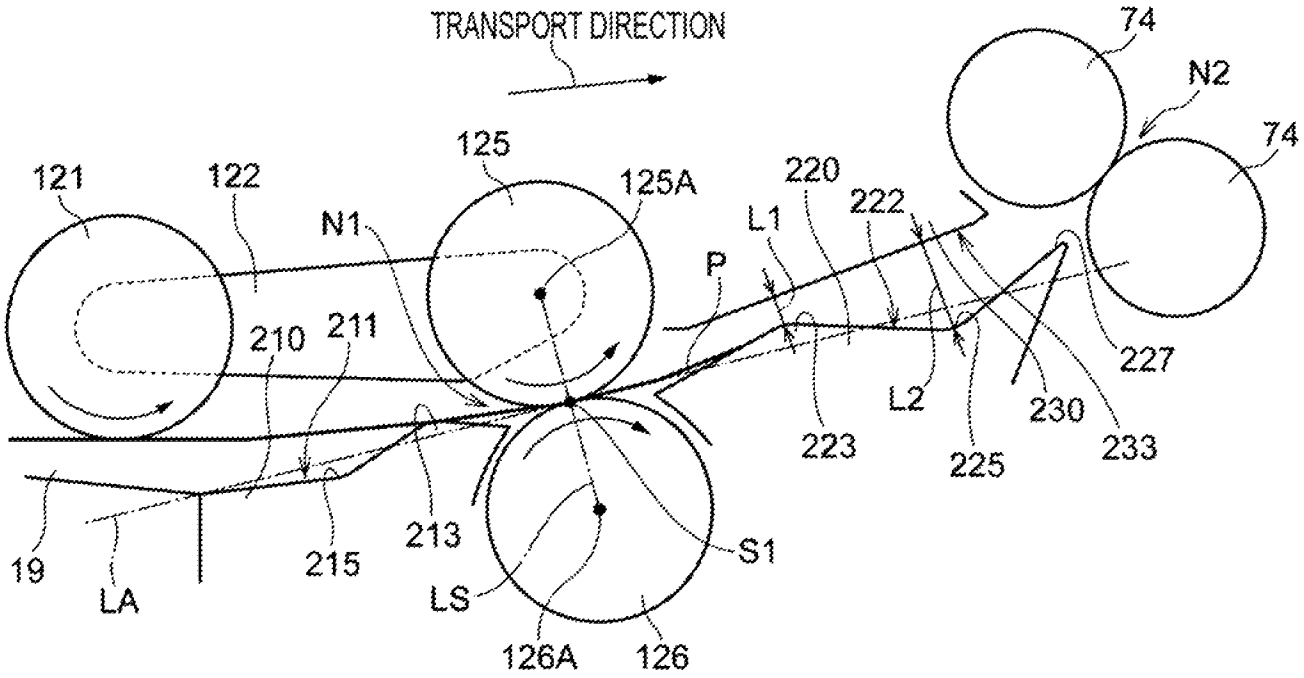
FIG. 3 is a schematic view illustrating a state where a sending roller transports a recording medium, in the configuration of the portion of the transport device illustrated in FIG. 2.

As illustrated in FIG. 3, the sending roller 121 is rotated in a counterclockwise rotation direction in FIG. 3 while contacting the upper surface of the recording medium P accommodated in the second accommodating unit 19, thereby sending the recording medium P from the second accommodating unit 19 to the right side in FIG. 3.

(Drive Roller 125 and Separation Roller 126)

The drive roller 125 is an example of a transport roller. The drive roller 125 is a transport roller that transports the recording medium P sent from the second accommodating unit 19. Specifically, the drive roller 125 is a drive roller that has a direction intersecting (specifically, a perpendicular direction, and a depth direction of the paper in FIG. 3) the transport direction as an axial direction, and rotates in a counterclockwise rotation direction in FIG. 3 around the axis by a drive unit (not illustrated).

The separation roller 126 is an example of a nip section. The separation roller 126 has a function of nipping the recording medium P with the drive roller 125, and preventing multi-feed of the recording medium P as follows. Specifically, the separation roller 126 is a driven roller that has a direction intersecting (specifically, a perpendicular direction, and a depth direction of the paper in FIG. 3) the transport direction as an axial direction, and rotates in a clockwise rotation direction in FIG. 3 around the axis.

More specifically, the separation roller 126 faces the lower side of the drive roller 125. Therefore, a nip area (hereinafter, referred to as a "nip area N1") to which the recording medium P sent from the second accommodating unit 19 is sandwiched is formed between the drive roller 125 and the separation roller 126. Further, a torque limiter (not illustrated) is attached to a shaft portion of the separation roller 126.

In the transport device 15, when the recording medium P is sent to the nip area N1, the drive roller 125 comes into contact with the upper surface (surface) on the front end side (that is, downstream in the transport direction) of the recording medium P and is rotationally driven, so that the recording medium P is transported to the downstream in the transport direction. Meanwhile, when the recording medium P comes into contact with the outer peripheral surface of the separation roller 126, and a predetermined rotational force is applied to the separation roller 126 due to friction with the recording medium P, the separation roller 126 starts to be driven. Until a predetermined rotational force is applied to the separation roller 126, the separation roller 126 functions as a brake that generates a rotational load.

Then, the separation roller 126 functions as a brake, so that when plural recording media P are overlapped and introduced into the nip area N1, transport resistance is applied to the recording media P from the lower surface side (back surface side) to prevent the multi-feed of the recording medium P transported by the drive roller 125.

As described above, when the plural recording media P are overlapped and sent to the nip area N1 from the second accommodating unit 19, the drive roller 125 applies transport force to the upper recording medium P (first recording medium P), meanwhile, the separation roller 126 applies transport resistance to the lower recording medium P (the second and subsequent recording media P). That is, the overlapped recording media P are separated (spread) by the drive roller 125 and the separation roller 126, and the recording medium P is transported one by one.

(Pair of Transport Rollers 74)

The pair of transport rollers 74 illustrated in FIG. 3 is an example of a transport member. As described above, the pair of transport rollers 74 include a pair of rollers facing each other. Therefore, a nip area (hereinafter, referred to as a "nip area N2") to which the recording medium P transported from the drive roller 125 is sandwiched is formed between the transport rollers 74.

The transport rollers 74 are disposed downstream of the second guide 220 in the transport direction and on the drive roller 125 side (specifically, the upper side) of the separation roller 126. Specifically, the nip area N2 of the transport rollers 74 is disposed on the drive roller 125 side of the separation roller 126. More specifically, the nip area N2 of the transport rollers 74 is disposed above the nip line LA.

In other words, the nip area N2 of the transport rollers 74 is disposed on the drive roller 125 side (specifically, upper side) more than the nip area N1 between the drive roller 125 and the separation roller 126. Therefore, the recording medium P is transported obliquely upward from the nip area N1 toward the nip area N2. A portion of the lower roller of the transport rollers 74 is located below the nip line LA.

Then, in the transport device 15, the recording medium P accommodated in the second accommodating unit 19 is transported to the discharge unit 13 passing through the image forming unit 14 (specifically, the secondary transfer position T2) and the fixing device 16, by the sending roller 121, the drive roller 125, the separation roller 126, the pair of transport rollers 74, the pair of registration rollers 75, the pair of transport rollers 76, and the pair discharge rollers 77.

(First Guide 210)

As illustrated in FIG. 3, the first guide 210 is disposed upstream of the separation roller 126 in the transport direction, and has a function of guiding the transported recording medium P to the nip area N1. Specifically, the first guide 210 is disposed upstream of the separation roller 126 in the transport direction and downstream of the sending roller 121 in the transport direction.

The first guide 210 includes a first transport path surface 211 facing the drive roller 125 side (specifically, the upper side) of the separation roller 126. In the first guide 210, the recording medium P sent from the second accommodating unit 19 (see FIG. 1) by the sending roller 121 and transported is guided to the nip area N1 by the first transport path surface 211.

Further, the first transport path surface 211 includes a top portion 213 that protrudes toward the drive roller 125 side (specifically, upper side) beyond the nip line LA between the drive roller 125 and the separation roller 126. The first transport path surface 211 is an example of a transport path surface.

Here, the nip line LA is a perpendicular line to a line LS that connects a contact point S1 between the drive roller 125 and the separation roller 126 and the center 125A of the drive roller 125, that is, a perpendicular line that passes through the contact point S1. When the drive roller 125 and the separation roller 126 come into contact with each other with a width in the transport direction, the center point in the transport direction in the contact area is the contact point S1. The line LS may be a line that connects the center 125A of the drive roller 125 and the center 126A of the separation roller 126. In each drawing, in order to make it easy to understand the positional relationship with the nip line LA, there are portions where the unevenness of the first guide 210 and the second guide 220 is exaggerated.

The first transport path surface 211 has a downward inclination that is lowered toward the separation roller 126 side (specifically, the lower side) of the drive roller 125, as it goes from the top portion 213 toward the downstream in the transport direction. The downward inclination is gradually lowered, and reaches the lower side of the nip line LA.

Further, the first transport path surface 211 has a bottom portion 215 that is recessed toward the separation roller 126 (specifically, the lower side) of the drive roller 125. The bottom portion 215 is located upstream in the transport direction of the top portion 213. The bottom portion 215 is disposed on the separation roller 126 side (specifically, the lower side) of the nip line LA.

In other words, the first transport path surface 211 has a downward inclination that is lowered toward the lower side of the nip line LA as it goes from the top portion 213 toward the bottom portion 215. In other words again, the first transport path surface 211 has an upward inclination that is risen toward the upper side of the nip line LA as it goes from the bottom portion 215 toward the top portion 213. The upward inclination gradually rises.

(Second Guide 220)

The second guide 220 is disposed downstream of the separation roller 126 in the transport direction, and has a function of guiding the transported recording medium P to the transport rollers 74 (specifically, nip area N2). Specifically, the second guide 220 is disposed upstream of the transport rollers 74 in the transport direction and downstream of the separation roller 126 in the transport direction.

The second guide 220 includes a second transport path surface 222 facing the drive roller 125 side (specifically, the upper side) of the separation roller 126. In the second guide 220, the recording medium P transported by the drive roller 125 is guided to the transport rollers 74 (specifically, nip area N2) by the second transport path surface 222.

Further, the second transport path surface 222 includes a top portion 223 that protrudes toward the drive roller 125 side (specifically, upper side) beyond the nip line LA between the drive roller 125 and the separation roller 126. The second transport path surface 222 is an example of a transport path surface.

The second transport path surface 222 has a downward inclination that is lowered toward the separation roller 126 side (specifically, the lower side) of the drive roller 125, as it goes from the top portion 223 toward the upstream in the transport direction. The downward inclination is gradually lowered, and reaches the lower side of the nip line LA.

Further, the second transport path surface 222 has a bottom portion 225 that is disposed downstream of the top portion 223 in the transport direction and that is recessed toward the separation roller 126 side (specifically, the lower side) of the drive roller 125. The bottom portion 225 is disposed on the separation roller 126 side (specifically, the lower side) of the nip line LA.

In other words, the second transport path surface 222 has a downward inclination that is lowered toward the lower side of the nip line LA as it goes from the top portion 223 toward the bottom portion 225. In other words again, the second transport path surface 222 has an upward inclination that is risen toward the upper side of the nip line LA as it goes from the bottom portion 225 toward the upstream in the transport direction. The upward inclination gradually rises.

Further, the second transport path surface 222 has an overhanging portion 227 that is disposed downstream of the bottom portion 225 in the transport direction and that protrudes toward the drive roller 125 side (specifically, the upper side) of the separation roller 126. The overhanging portion 227 is disposed on the drive roller 125 side (specifically, the upper side) of the nip line LA.

In other words, the second transport path surface 222 has an upward inclination that is risen toward the upper side of the nip line LA as it goes from the bottom portion 225 toward the overhanging portion 227. The upward inclination gradually rises.

Further, the top portion 223 of the second transport path surface 222 is disposed on the drive roller 125 side (specifically, upper side) more than the top portion 213 of the first transport path surface 211. Therefore, the recording medium P is approximately transported obliquely upward from the top portion 213 toward the top portion 223.

(Third Guide 230)

The third guide 230 faces the second guide 220. That is, the third guide 230 is disposed upstream of the transport rollers 74 in the transport direction and downstream of the drive roller 125 in the transport direction.

The third guide 230 includes a third transport path surface 233 facing the second transport path surface 222. That is, the third transport path surface 233 faces the separation roller 126 side (specifically, the lower side) of the drive roller 125.

A distance between the third transport path surface 233 and the second transport path surface 222 increases from the top portion 223 to the bottom portion 225 of the second transport path surface 222. That is, the shortest distance L2 between the third transport path surface 233 and the bottom portion 225 of the second transport path surface 222 is larger than the shortest distance L1 between the third transport path surface 233 and the top portion 223 of the second transport path surface 222.

Specifically, the second transport path surface 222 has the downward inclination that is lowered toward the lower side of the nip line LA as it goes from the top portion 223 toward the bottom portion 225, whereas the third transport path surface 233 has an inclination in a direction away from the second transport path surface 222 in an opposing portion facing each other in the range from the top portion 223 to the bottom portion 225. More specifically, the third transport path surface 233 has an upward inclination that is risen toward the upper side of the nip line LA in the opposing portion.

More specifically, the third transport path surface 233 has a height difference (that is, difference between the highest value and the lowest value) in the direction along the line LS smaller than that of the second transport path surface 222. That is, the third transport path surface 233 includes a path surface similar to a plane surface along the nip line LA.

(Action According to Exemplary Embodiment)

In the image forming apparatus 10 illustrated in FIG. 1, as illustrated in FIG. 3, the recording medium P accommodated in the second accommodating unit 19 is sent from the second accommodating unit 19 by the sending roller 121. The recording medium P sent from the second accommodating unit 19 is introduced to the nip area N1, and is transported to the transport rollers 74 by the drive roller 125.

In the present exemplary embodiment, the separation roller 126 functions as a brake, so that when plural recording media P are overlapped and introduced into the nip area N1, transport resistance is applied to the recording media P from the lower surface side (back surface side) to prevent the multi-feed of the recording medium P transported by the drive roller 125.

As described above, when the plural recording media P are overlapped and sent to the nip area N1 from the second accommodating unit 19, the drive roller 125 applies transport force to the upper recording medium P (first recording medium P), meanwhile, the separation roller 126 applies transport resistance to the lower recording medium P (the second and subsequent recording media P). That is, the overlapped recording media P are separated (spread) by the drive roller 125 and the separation roller 126, and the recording medium P is transported one by one.

Then, in the present exemplary embodiment, the first transport path surface 211 of the first guide 210 guides the recording medium P sent from the second accommodating unit 19 by the sending roller 121 and transported to the nip area N1. Further, the recording medium P transported by the drive roller 125 is guided to the transport rollers 74 (specifically, nip area N2) by the second transport path surface 222 of the second guide 220.

Here, in the present exemplary embodiment, the first transport path surface 211 includes the top portion 213 that protrudes toward the drive roller 125 side beyond the nip line LA between the drive roller 125 and the separation roller 126. Further, the second transport path surface 222 includes the top portion 223 that protrudes toward the drive roller 125 side beyond the nip line LA between the drive roller 125 and the separation roller 126.

Figure 4:
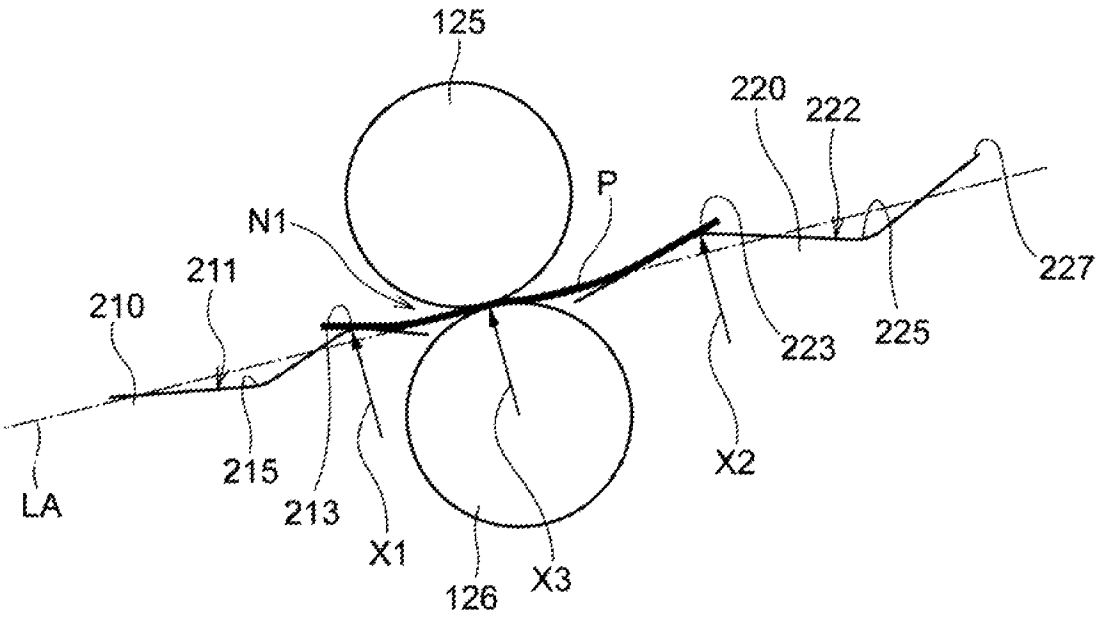
FIG. 4 is a schematic view for explaining an action of two top portions, in the configuration of the portion of the transport device according to the exemplary embodiment.

Therefore, as illustrated in FIG. 4, the transported recording medium P is lifted to the drive roller 125 side from the nip line LA (see arrow X1 and arrow X2) upstream and downstream in the transport direction of the nip area N1. As a result, the recording medium P is pressed against the drive roller 125 (see arrow X3). Therefore, the recording medium P has a larger contact area with the drive roller 125 than a contact area with the separation roller 126.

In other words, in the present exemplary embodiment, it may be said that the first transport path surface 211 and the second transport path surface 222 cause the posture of the recording medium P to be a posture such that the contact area between the recording medium P and the drive roller 125 is larger than the contact area between the recording medium P and the separation roller 126. Each drawing in FIGS. 4 to 12, a portion of the recording medium P is illustrated.

Figure 5:
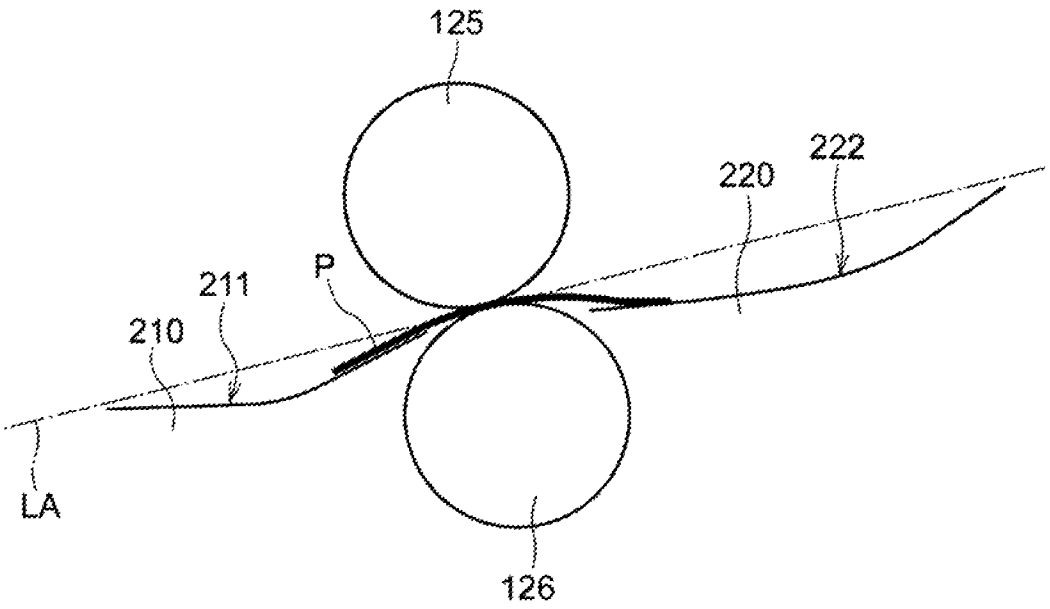
FIG. 5 is a schematic view illustrating a configuration of a comparative example that does not have two top portions.

Here, as illustrated in FIG. 5, in a configuration (hereinafter, referred to as a "first configuration") in which the entire first transport path surface 211 and the entire second transport path surface 222 are disposed on the separation roller 126 side of the nip line LA, the recording medium P is not pressed against the drive roller 125, and the contact area between the recording medium P and the drive roller 125 is equal to or less than the contact area between the recording medium P and the separation roller 126. That is, it may be said that the first configuration is a configuration that causes the posture of the recording medium P to be a posture such that the contact area between the recording medium P and the drive roller 125 is equal to or less than the contact area between the recording medium P and the separation roller 126.

In this regard, in the present exemplary embodiment, the recording medium P has a larger contact area with the drive roller 125 than a contact area with the separation roller 126, as compared with the first configuration. Therefore, the transport force of the drive roller 125 is transmitted to the recording medium P and the transport capability of the drive roller 125 is improved. That is, according to the present exemplary embodiment, as compared with the first configuration, it is easy to secure the transport force necessary for the drive roller 125 to transport the recording medium P.

Figure 6:
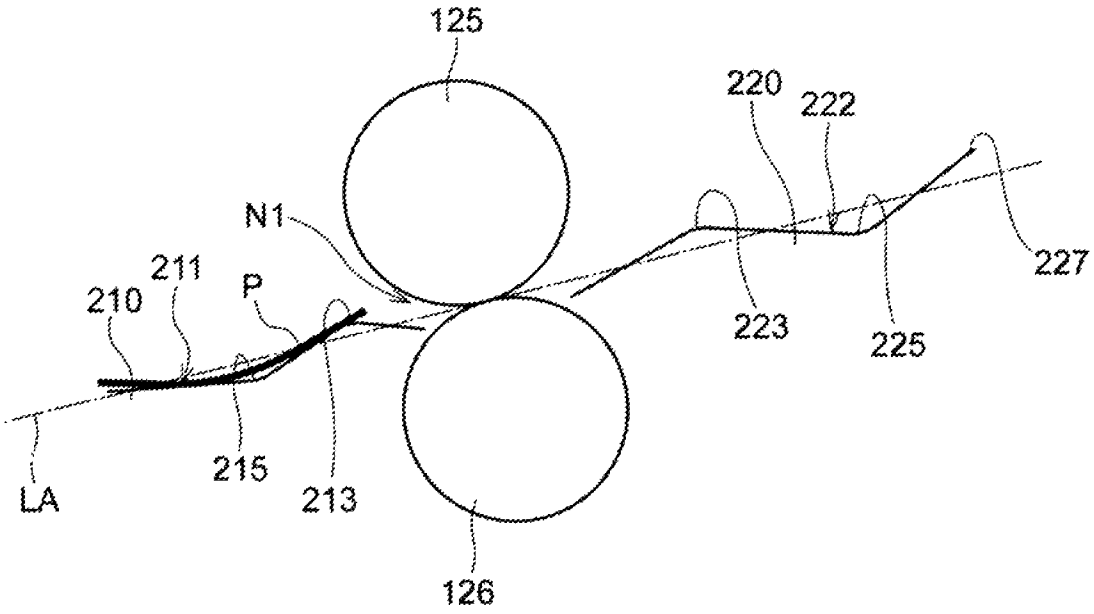
FIG. 6 is a schematic view illustrating an action of a bottom portion upstream of a nip area in a transport direction, in the configuration of the portion of the transport device according to the exemplary embodiment.

Further, in the present exemplary embodiment, the first transport path surface 211 has the bottom portion 215 that is recessed toward the separation roller 126 side of the drive roller 125 and that is positioned upstream of the top portion 213 in the transport direction. Therefore, as illustrated in FIG. 6, it is easy for the recording medium P transported from the bottom portion 215 to the top portion 213 to be in a posture facing the drive roller 125 side (specifically, obliquely upward) of the separation roller 126.

Figure 7:
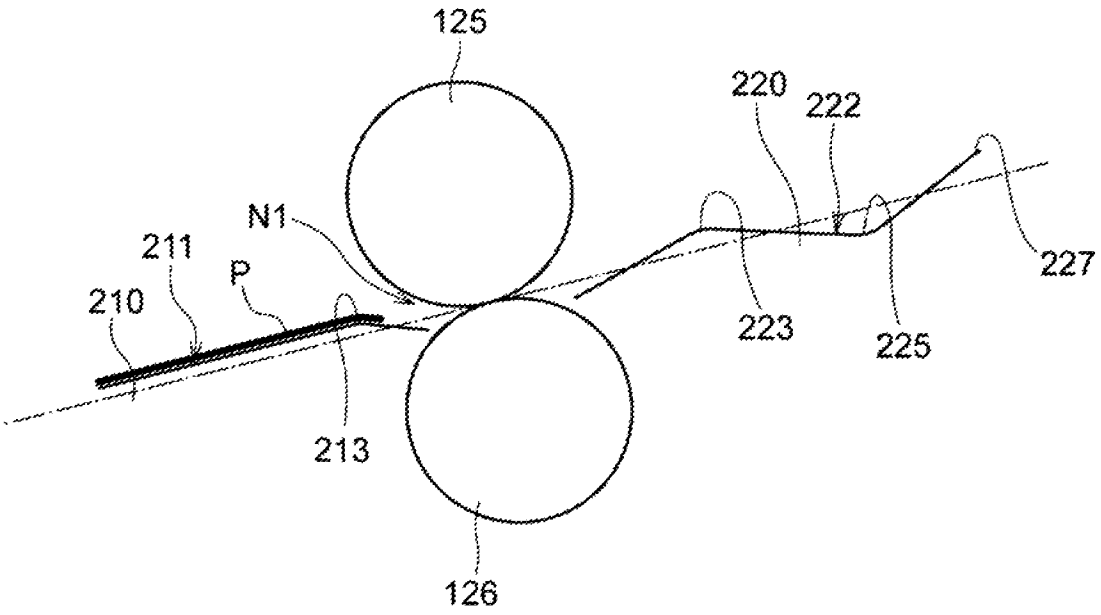
FIG. 7 is a schematic view illustrating a configuration in a case where there is no bottom portion upstream of the nip area in the transport direction.

Here, as illustrated in FIG. 7, in a configuration (hereinafter, referred to as a "second configuration") in which the height is constant from the top portion 213 of the first transport path surface 211 toward the upstream in the transport direction, the recording medium P is in a posture that faces the separation roller 126 side (specifically, obliquely downward) of the drive roller 125, due to the downward inclination from the top portion 213 to the nip area N1, after being transported to the top portion 213 in the posture along the nip line LA. Then, when the recording medium P is introduced to the nip area N1 with the posture facing obliquely downward, the recording medium P is likely to come into contact with the separation roller 126, and thus, it is difficult to receive drive force of the drive roller 125.

In this regard, in the present exemplary embodiment, since the recording medium P transported to the top portion 213 becomes the posture facing obliquely upward, as compared with the second configuration, it is each for the recording medium P to be introduced to the nip area N1 in the posture facing obliquely upward. Therefore, the recording medium P is likely to come into contact with the drive roller 125, and to receive the drive force of the drive roller 125. As a result, according to the present exemplary embodiment, as compared with the second configuration, the transport force of the drive roller 125 is transmitted to the recording medium P, and the transport capability of the drive roller 125 is improved.

Further, in the present exemplary embodiment, the bottom portion 215 of the first transport path surface 211 is disposed on the separation roller 126 side of the nip line LA.

As a result, compared to a configuration (hereinafter, referred to as a "third configuration") in which the bottom portion 215 of the first transport path surface 211 is disposed on the drive roller 125 side of the nip line LA, the range of the upward inclination from the bottom portion 215 to the top portion 213 becomes longer, or the upward inclination becomes steep, and it is easy for the recording medium P to be introduced to the nip area N1 with the posture facing obliquely upward. Therefore, according to the present exemplary embodiment, as compared with the third configuration, the recording medium P is likely to come into contact with the drive roller 125, and to receive the drive force of the drive roller 125. As a result, according to the present exemplary embodiment, as compared with the third configuration, the transport force of the drive roller 125 is transmitted to the recording medium P, and the transport capability of the drive roller 125 is improved.

Figure 8:
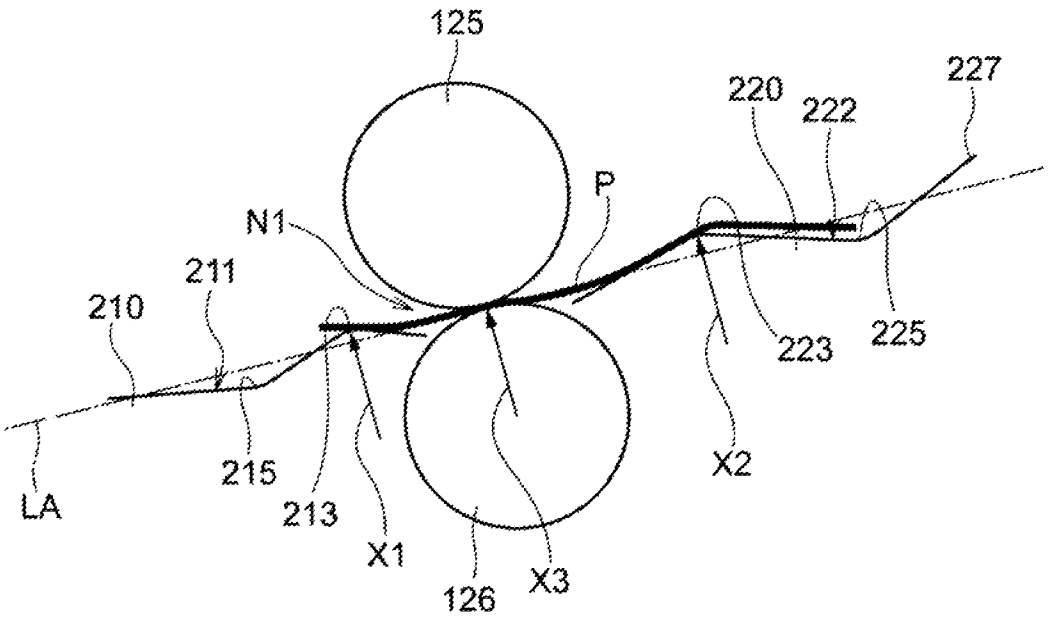
FIG. 8 is a schematic view for explaining an action of a bottom portion downstream of the nip area in the transport direction, in the configuration of the portion of the transport device according to the exemplary embodiment.

Further, in the present exemplary embodiment, the second transport path surface 222 has a bottom portion 225 that is recessed toward the separation roller 126 side (specifically, the lower side) of the drive roller 125, downstream of the top portion 223 in the transport direction. Therefore, as illustrated in FIG. 8, the recording medium P transported from the top portion 223 to the bottom portion 225 is likely to be in a posture facing the separation roller 126 side (specifically, obliquely downward) of the drive roller 125.

Figure 9:
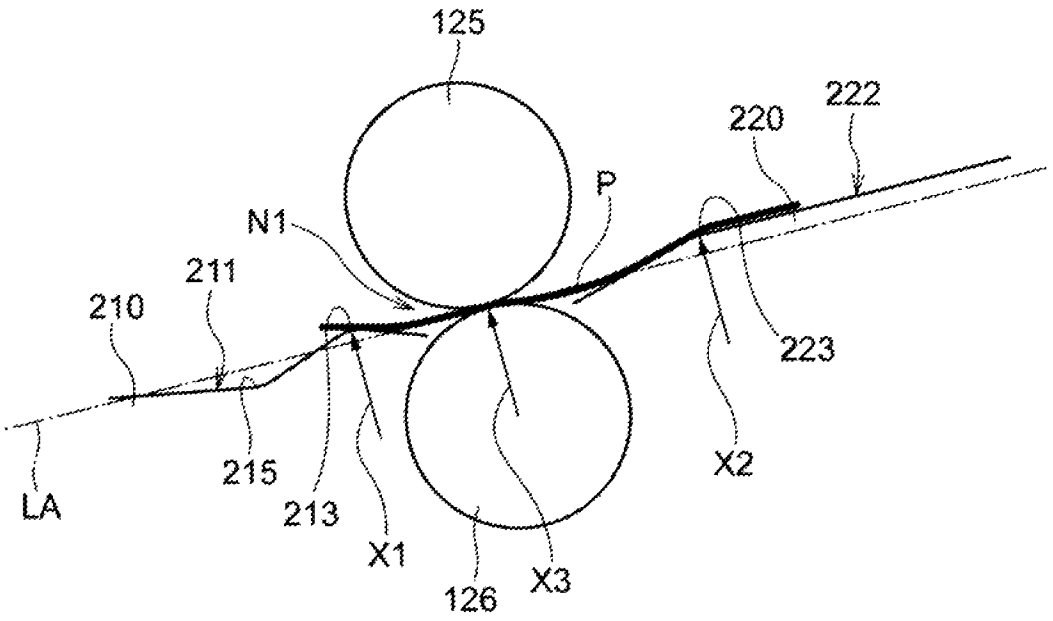
FIG. 9 is a schematic view illustrating a configuration in a case where there is no bottom portion downstream of the nip area in the transport direction.

Here, as illustrated in FIG. 9, in a configuration (hereinafter, referred to as a "fourth configuration") in which the height is constant from the top portion 223 of the second transport path surface 222 toward the downstream in the transport direction, the recording medium P is transported in the posture along the nip line LA from the top portion 213 to the downstream in the transport direction.

In this regard, in the present exemplary embodiment, since the recording medium P transported from the top portion 223 to the bottom portion 225 becomes the posture facing obliquely downward, as compared with the fourth configuration, the portion of the recording medium P on the rear end side (upstream in the transport direction) with respect to the top portion 223 is easily lifted with the top portion 223 as a fulcrum. Therefore, as compared with the fourth configuration, it is easy for the recording medium P to be pressed against the drive roller 125, and to have a larger contact area with the drive roller 125 than a contact area with the separation roller 126. As a result, according to the present exemplary embodiment, as compared with the fourth configuration, the transport force of the drive roller 125 is transmitted to the recording medium P, and the transport capability of the drive roller 125 is improved.

Further, in the present exemplary embodiment, the bottom portion 225 of the second transport path surface 222 is disposed on the separation roller 126 side of the nip line LA.

Therefore, as compared with a configuration (hereinafter, referred to as a "fifth configuration") in which the bottom portion 225 of the second transport path surface 222 is disposed on the drive roller 125 side of the nip line LA, the recording medium P transported from the top portion 223 to the bottom portion 225 is likely to be in a posture facing the separation roller 126 side (specifically, obliquely downward) of the drive roller 125. Therefore, according to the present exemplary embodiment, as compared with the fifth configuration, the portion of the recording medium P on the rear end side (upstream in the transport direction) with respect to the top portion 223 is easily lifted with the top portion 223 as a fulcrum. Therefore, as compared with the fifth configuration, it is easy for the recording medium P to be pressed against the drive roller 125, and to have a larger contact area with the drive roller 125 than a contact area with the separation roller 126. As a result, according to the present exemplary embodiment, as compared with the fifth configuration, the transport force of the drive roller 125 is transmitted to the recording medium P, and the transport capability of the drive roller 125 is improved.

Figure 10:
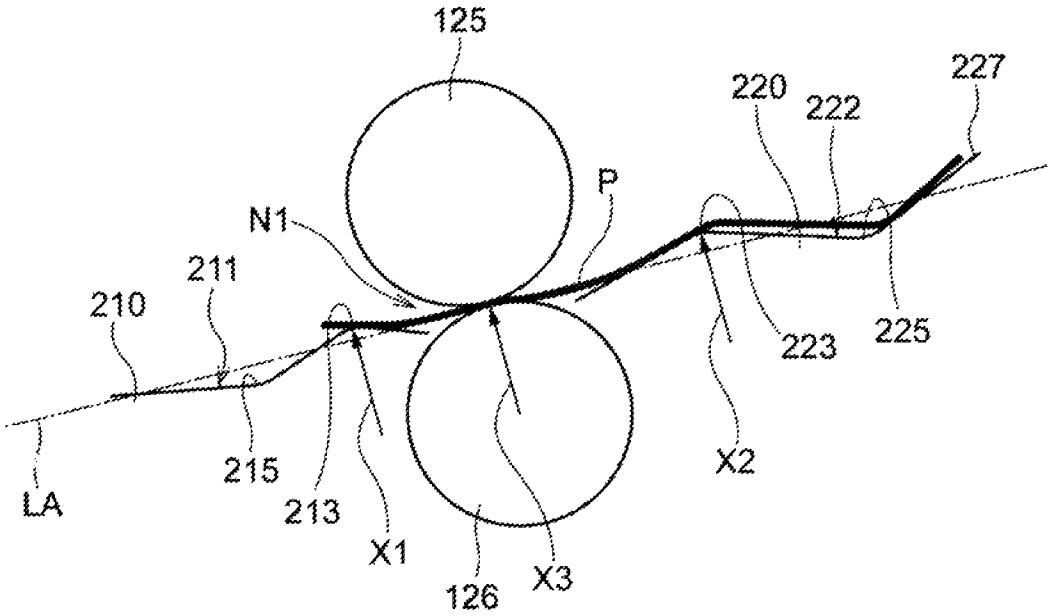
FIG. 10 is a schematic view for explaining an action of an overhanging portion, in the configuration of the portion of the transport device according to the exemplary embodiment.

Further, in the present exemplary embodiment, the second transport path surface 222 has the overhanging portion 227 that protrudes toward the drive roller 125 side (specifically, the upper side) of the separation roller 126, downstream of the bottom portion 225 in the transport direction. Therefore, as illustrated in FIG. 10, the recording medium P transported from the bottom portion 225 to the overhanging portion 227 becomes a posture facing the drive roller 125 side (specifically, obliquely upward) of the separation roller 126. Therefore, the recording medium P is likely to be deformed into a convex shape at the bottom portion 225 toward the separation roller 126 side (specifically, the lower side).

Figure 11:
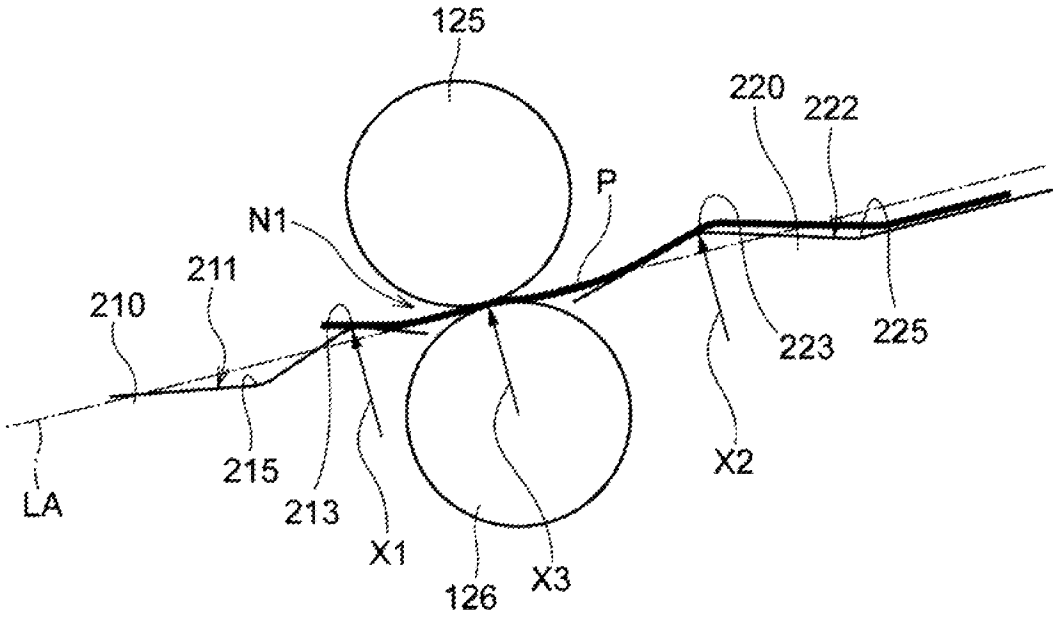
FIG. 11 is a schematic view illustrating a configuration in a case where there is no overhanging portion.

Here, as illustrated in FIG. 11, in a configuration (hereinafter, referred to as a "sixth configuration") in which the second transport path surface 222 includes only the top portion 223 and the bottom portion 225, the recording medium P is likely to be deformed into the convex shape at the top portion 223 toward the drive roller 125 side (specifically, upper side).

In this regard, in the present exemplary embodiment, since the recording medium P is deformed into the convex shape at the bottom portion 225 toward the lower side after being deformed into the convex shape at the top portion 223 toward the upper side, as compared with the sixth configuration, the recording medium P is prevented from being deformed into the convex shape biasing toward one side (specifically, upper side) in the vertical direction. Further, according to the present exemplary embodiment, the overhanging portion 227 causes the recording medium P to have the posture such that the recording medium P faces upward. Therefore, as compared with the sixth configuration, it is easy to form a transport path toward the transport rollers 74 disposed on the upper side of the separation roller 126.

Further, in the present exemplary embodiment, the overhanging portion 227 of the second transport path surface 222 is disposed on the drive roller 125 side of the nip line LA. Therefore, as compared with a configuration (hereinafter, referred to as a "seventh configuration") in which the overhanging portion 227 of the second transport path surface 222 is disposed on the separation roller 126 side of the nip line LA, the recording medium P transported from the bottom portion 225 to the overhanging portion 227 is likely to be in a posture facing the drive roller 125 side (specifically, obliquely upward) of the separation roller 126. Therefore, according to the present exemplary embodiment, as compared with the seventh configuration, the recording medium P is prevented from being deformed into the convex shape upward. Further, according to the present exemplary embodiment, the recording medium P easily becomes the posture such that the recording medium P faces upward. Therefore, as compared with the seventh configuration, it is easy to form the transport path toward the transport rollers 74 disposed on the upper side of the separation roller 126.

Further, in the present exemplary embodiment, as illustrated in FIG. 3, the distance between the third transport path surface 233 and the second transport path surface 222 increases from the top portion 223 to the bottom portion 225 of the second transport path surface 222.

Figure 12:
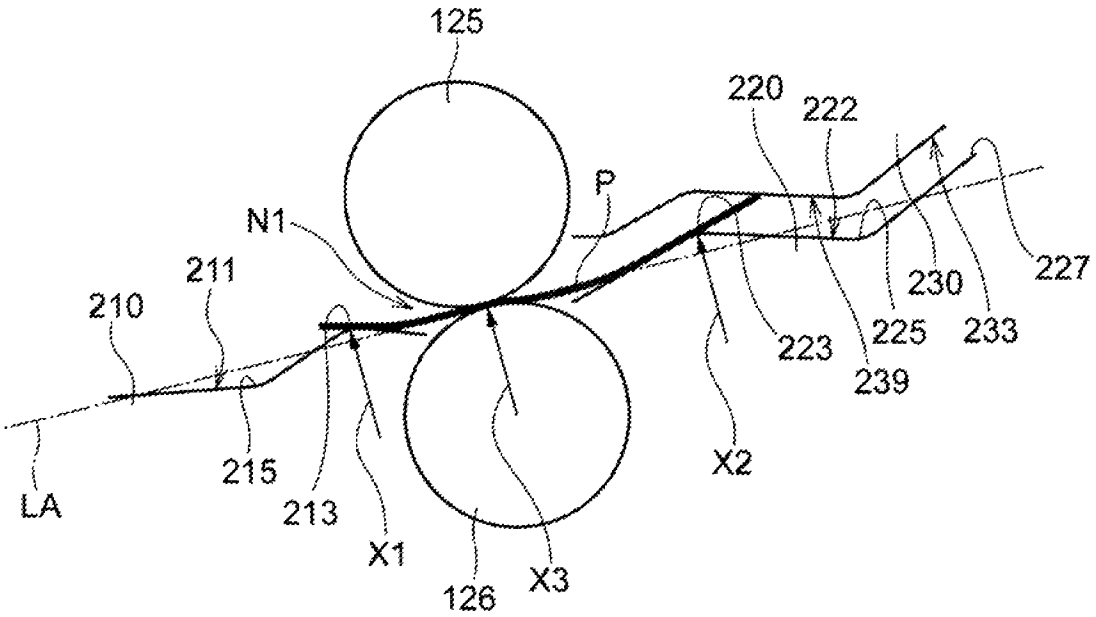
FIG. 12 is a schematic view illustrating a configuration in which a distance between an upper and lower transport path surfaces downstream of the nip area in the transport direction is constant.

Here, as illustrated in FIG. 12, in a configuration (hereinafter, referred to as a "eighth configuration") in which the distance between the third transport path surface 233 and the second transport path surface 222 is constant from the top portion 223 to the bottom portion 225 of the second transport path surface 222, a facing surface 239 of the third transport path surface 233 facing the second transport path surface 222 from the top portion 223 to the bottom portion 225 has a downward inclination to the downstream in the transport direction that is the same as the inclination of the second transport path surface 222. In this case, the recording medium P transported from the top portion 223 to the bottom portion 225 of the second transport path surface 222 is likely to be caught on the facing surface 239, and a transport failure of the recording medium P may occur.

In this regard, according to the present exemplary embodiment, since the distance between the third transport path surface 233 and the second transport path surface 222 increases from the top portion 223 to the bottom portion 225 of the second transport path surface 222, the facing surface 239 of the third transport path surface 233 does not have a downward inclination to the downstream in the transport direction, or even if the facing surface 239 has a downward inclination, the inclination is smaller than the inclination of the second transport path surface 222.

As a result, as compared with the eighth configuration, the transported recording medium P is hardly caught on the facing surface 239, and the transport failure of the recording medium P is prevented.

Further, in the present exemplary embodiment, the top portion 223 of the second transport path surface 222 is disposed on the drive roller 125 side (that is, upper side) more than the top portion 213 of the first transport path surface 211.

As a result, as compared with a configuration (hereinafter, referred to as a "ninth configuration") in which the top portion 223 of the second transport path surface 222 has the same height as the top portion 213 of the first transport path surface 211, it is easy to become the posture facing the upper side (see FIG. 4). As a result, according to the present exemplary embodiment, as compared with the ninth configuration, it is easy to form the transport path toward the transport rollers 74 disposed on the upper side of the separation roller 126.

As described above, according to the present exemplary embodiment, since the transport capability of the drive roller 125 is improved, the transport failure in the transport device 15 is prevented. As a result, the image failure due to the transport failure in the transport device 15 is prevented.

(Modification)

In the present exemplary embodiment, as an example of a nip section, the separation roller 126 is used. However, the present disclosure is not limited thereto. For example, examples of a nip section may include, for example, a non-rotatable member (for example, a pad) that comes into contact with the recording medium P.

Further, in the present exemplary embodiment, the drive roller 125 is used as an example of a transport roller, and the separation roller 126 is used as an example of a nip section. However, the present disclosure is not limited thereto. For example, the upper roller of the transport rollers 72 may be configured the same as the drive roller 125 to use an example of a transport roller, and the lower roller of the transport rollers 72 may be configured the same as the separation roller 126 to use an example of a nip section. In this case, the first accommodating unit 12 is an example of an accommodating unit.

Further, in the present exemplary embodiment, the first transport path surface 211 has the bottom portion 215 that is recessed toward the separation roller 126 side of the drive roller 125. The bottom portion 215 is located upstream of the top portion 213 in the transport direction. However, the present disclosure is not limited thereto. For example, as illustrated in FIG. 7, the height may be constant from the top portion 213 of the first transport path surface 211 toward the upstream in the transport direction.

Further, in the present exemplary embodiment, the bottom portion 215 of the first transport path surface 211 is disposed on the separation roller 126 side of the nip line LA. However, the present disclosure is not limited thereto. For example, the bottom portion 215 of the first transport path surface 211 may be disposed on the drive roller 125 side of the nip line LA, or may be disposed on the nip line LA.

Further, in the present exemplary embodiment, the second transport path surface 222 has a bottom portion 225 that is disposed downstream of the top portion 223 in the transport direction and that is recessed toward the separation roller 126 side (specifically, the lower side) of the drive roller 125. However, the present disclosure is not limited thereto. For example, as illustrated in FIG. 9, the height may be constant from the top portion 223 of the second transport path surface 222 toward the downstream in the transport direction.

Further, in the present exemplary embodiment, the bottom portion 225 of the second transport path surface 222 is disposed on the separation roller 126 side of the nip line LA. However, the present disclosure is not limited thereto. For example, the bottom portion 225 of the second transport path surface 222 may be disposed on the drive roller 125 side of the nip line LA, or may be disposed on the nip line LA.

Further, in the present exemplary embodiment, the second transport path surface 222 has the overhanging portion 227 that is disposed downstream of the bottom portion 225 in the transport direction and that protrudes toward the drive roller 125 side (specifically, the upper side) of the separation roller 126. However, the present disclosure is not limited thereto. For example, as illustrated in FIG. 11, the second transport path surface 222 may only include the top portion 223 and the bottom portion 225.

Further, in the present exemplary embodiment, the overhanging portion 227 of the second transport path surface 222 is disposed on the drive roller 125 side of the nip line LA. However, the present disclosure is not limited thereto. For example, the overhanging portion 227 of the second transport path surface 222 may be disposed on the separation roller 126 side of the nip line LA.

In the exemplary embodiment, as illustrated in FIG. 3, a distance between the third transport path surface 233 and the second transport path surface 222 increases from the top portion 223 to the bottom portion 225 of the second transport path surface 222. However, the present disclosure is not limited thereto. For example, as illustrated in FIG. 12, the distance between the third transport path surface 233 and the second transport path surface 222 may be constant from the top portion 223 to the bottom portion 225 of the second transport path surface 222.

Further, in the exemplary embodiment, the top portion 223 of the second transport path surface 222 is disposed on the drive roller 125 side (specifically, upper side) more than the top portion 213 of the first transport path surface 211. However, the present disclosure is not limited thereto. For example, the top portion 223 of the second transport path surface 222 may have the same height as the top portion 213 of the first transport path surface 211, and may be disposed below the top portion 213.

The present disclosure is not limited to the above exemplary embodiments, and various modifications, changes, and improvements may be made without departing from the spirit of the present disclosure. For example, the modifications described above may be appropriately combined with each other.

The foregoing description of the exemplary embodiments of the present disclosure has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport device comprising:

a transport roller configured to transport a transport target material sent from an accommodating unit;

a nip section configured to nip the transport target material with the transport roller, and prevent multi-feed of the transport target material;

a first transport path surface disposed upstream of the nip section in a transport direction to face a transport roller side of the nip section, the first transport path surface comprising a bottom portion recessed toward a nip section side of the transport roller and disposed beyond a nip line between the transport roller and the nip section on a nip section side of the nip line, a top portion located downstream of the bottom portion in the transport direction and protruding toward the transport roller side beyond the nip line on a transport roller side of the nip line, a downward inclination portion extending in the downstream direction from beyond the nip line on the transport roller side to the bottom portion, and an upward inclination portion extending in the downstream direction from the bottom portion to the top portion; and a second transport path surface disposed downstream of the nip section in the transport direction to face the transport roller side of the nip section, the second transport path surface comprising a top portion protruding toward the transport roller side beyond the nip line.

2. The transport device according to claim 1, wherein the bottom portion is located downstream of a roller located adjacent to and upstream from the nip section.

3. The transport device according to claim 1, wherein the second transport path surface further comprises a bottom portion that is located downstream of the top portion of the second transport path surface in the transport direction and that is recessed toward the nip section side of the transport roller.

4. The transport device according to claim 3, wherein the bottom portion of the second transport path surface is disposed on the nip section side of the nip line.

5. The transport device according to claim 3, wherein the second transport path surface further comprises an overhanging portion that is located downstream of the bottom portion of the second transport path surface in the transport direction and that overhangs toward the transport roller side of the nip section.

6. The transport device according to claim 5, wherein the overhanging portion of the second transport path surface is disposed on the transport roller side of the nip line.

7. The transport device according to claim 3, further comprising:

a third transport path surface that faces the second transport path surface, and a distance between the second transport path surface and the third transport path surface increases from the top portion of the second transport path surface to the bottom portion of the second transport path surface.

8. The transport device according to claim 1, further comprising:

a transport member disposed downstream of the second transport path surface in the transport direction and on the transport roller side of the nip section, wherein the top portion of the second transport path surface is disposed on the transport roller side of the top portion of the first transport path surface.

9. A transport device comprising:

a transport roller configured to transport a transport target material sent from an accommodating unit;

a nip section configured to nip the transport target material with the transport roller, and prevent multi-feed of the transport target material; and transport path surfaces, at least one of the transport path surfaces being disposed upstream of the nip section in a transport direction, at least another one of the transport path surfaces being disposed downstream of the nip section in the transport direction, the transport path surfaces being configured to cause a posture of the transport target material to be a posture such that a contact area between the transport target material and the transport roller is larger than a contact area between the transport target material and the nip section.

10. An image forming apparatus comprising:

the transport device according to claim 1; and an image forming unit disposed downstream of the second transport path surface in the transport direction, the image forming unit being configured to form an image on the transport target material.

11. An image forming apparatus comprising:

the transport device according to claim 2; and an image forming unit disposed downstream of the second transport path surface in the transport direction, the image forming unit being configured to form an image on the transport target material.

12. An image forming apparatus comprising:

the transport device according to claim 3; and an image forming unit disposed downstream of the second transport path surface in the transport direction, the image forming unit being configured to form an image on the transport target material.

13. An image forming apparatus comprising:

the transport device according to claim 4; and an image forming unit disposed downstream of the second transport path surface in the transport direction, the image forming unit being configured to form an image on the transport target material.

14. An image forming apparatus comprising:

the transport device according to claim 5; and an image forming unit disposed downstream of the second transport path surface in the transport direction, the image forming unit being configured to form an image on the transport target material.

15. An image forming apparatus comprising:

the transport device according to claim 6; and an image forming unit disposed downstream of the second transport path surface in the transport direction, the image forming unit being configured to form an image on the transport target material.

16. An image forming apparatus comprising:

the transport device according to claim 7; and an image forming unit disposed downstream of the second transport path surface in the transport direction, the image forming unit being configured to form an image on the transport target material.

17. An image forming apparatus comprising:

the transport device according to claim 8; and an image forming unit disposed downstream of the second transport path surface in the transport direction, the image forming unit being configured to form an image on the transport target material.

18. A transport device comprising:

transport means for transporting a transport target material sent from an accommodating unit;

nip means for nipping the transport target material with the transport means, and preventing multi-feed of the transport target material;

a first transport path surface disposed upstream of the nip means in a transport direction to face a transport means side of the nip means, the first transport path surface comprising a bottom portion recessed toward a nip means side of the transport means and disposed beyond a nip line between the transport means and the nip means on a nip means side of the nip line, a top portion located downstream of the bottom portion in the transport direction and protruding toward the transport means side beyond the nip line on a transport means side of the nip line, a downward inclination portion extending in the downstream direction from beyond the nip line on the transport means side to the bottom portion, and an upward inclination portion extending in the downstream direction from the bottom portion to the top portion; and a second transport path surface disposed downstream of the nip means in the transport direction to face the transport means side of the nip means, the second transport path surface comprising a top portion protruding toward the transport means side beyond the nip line.

19. The transport device according to claim 1, wherein the first transport path surface is configured to transport the target material to the nip section in an obliquely upward posture facing the transport roller.

* * * * *